US007515011B2

(12) United States Patent
Farnworth

(10) Patent No.: US 7,515,011 B2
(45) Date of Patent: Apr. 7, 2009

(54) MICROWAVE ROUTING ELEMENT, METHODS OF ROUTING MICROWAVES AND SYSTEMS INCLUDING SAME

(76) Inventor: Warren M. Farnworth, 2004 S. Banner, Nampa, ID (US) 83686

( * ) Notice: Subject to any disclaimer, the term of this patent is extended or adjusted under 35 U.S.C. 154(b) by 443 days.

(21) Appl. No.: 11/196,638

(22) Filed: Aug. 3, 2005

(65) Prior Publication Data

US 2007/0030090 A1 Feb. 8, 2007

(51) Int. Cl.
*H01P 1/14* (2006.01)
*H01P 1/10* (2006.01)
*H05H 1/46* (2006.01)

(52) U.S. Cl. ..... 333/13; 333/99 PL; 333/101

(58) Field of Classification Search ..... 333/13, 333/99 PL, 101
See application file for complete search history.

(56) References Cited

U.S. PATENT DOCUMENTS 2,493,706 A 1/1950 Washburne et al.
2,892,983 A * 6/1959 Larson ..... 333/13
3,023,380 A * 2/1962 Hill ..... 333/13
3,281,719 A 10/1966 Goldberg
3,619,692 A 11/1971 Day
4,255,731 A 3/1981 Birx
4,370,631 A 1/1983 Gerber et al.
5,321,222 A 6/1994 Bible et al.
5,384,794 A 1/1995 Takanaka
5,663,694 A * 9/1997 Goebel et al. ..... 333/157
6,037,849 A 3/2000 Ciezarek
6,758,609 B2 7/2004 Fathi et al.

* cited by examiner

*Primary Examiner*—Robert J. Pascal
*Assistant Examiner*—Kimberly E Glenn
(74) *Attorney, Agent, or Firm*—TraskBritt

(57) ABSTRACT

Microwave routing elements and methods of directing microwaves are disclosed. One routing element comprises an inlet region, a plurality of outlet regions, and junctures positioned between an associated outlet region and the inlet region. Each juncture includes electrodes configured for generating an electrical arc across the juncture to inhibit transmission of microwave energy when the arc is present and permit passage of the microwave energy when the arc is absent. Another routing element includes the inlet region, the outlet regions, and partitions positioned between an associated outlet region and the inlet region. Each partition includes apertures and each aperture includes electrodes configured for generating an electrical arc across the aperture to inhibit transmission of microwave energy when the arc is present and permit passage of microwave energy when the arc is absent. Systems including the routing element, a microwave source, and a plurality of microwave processing chambers are also disclosed.

28 Claims, 5 Drawing Sheets

MICROWAVE ROUTING ELEMENT, METHODS OF ROUTING MICROWAVES AND SYSTEMS INCLUDING SAME

BACKGROUND OF THE INVENTION

1. Field of the Invention

The present invention relates to microwave routing or switching devices, such as microwave waveguides, and devices and systems including same. Particularly, the present invention relates to selectively controlling the transmission of microwave energy via at least one electrical arc.

2. Background of Related Art

Conventional microwave switch devices are known in the art for switching microwave signals. Typically, such conventional microwave switches may be mechanically actuated (e.g., via rotary or linear movement) and may be configured for opening or closing apertures (within a waveguide, for instance) for allowing or preventing microwave energy transmission.

For example, some mechanical microwave switches, described in U.S. Pat. No. 6,037,849 to Ciezarek, include an actuator plate, which is mechanically coupled to reeds of a connection assembly, that may be employed for placing the connection assembly into the selected position. Thus, during operation of the switch, a magnetic force of a permanent magnet may be substantially the only holding force that holds the actuator plate (coupled to various reeds) in place in at least one direction. In another example, a prior art microwave switch of a rotary type is described in U.S. Pat. No. 4,370,631 to Gerber et al., and comprises a rotor, a rotor housing, two biasing means, a housing for the biasing means and an electronic circuit to control the biasing means. The rotor and the housing are of conventional design. The biasing means comprise two rotary solenoids, which are mechanically linked to a Maltese transmission mechanism.

Microwave switches may be employed in a variety of applications, including microwave heating/processing, space applications, or other applications. Of course, performance considerations, such as the amount of time for actuating the switch may be of importance. It may be difficult to manufacture parts for a mechanical microwave switch with sufficiently high precision to permit suitable control of microwave energy. Furthermore, mechanical systems may be prone to relatively slow actuation times (i.e., switching times) and also may be prone to mechanical failure. It may be, therefore, desirable to provide a microwave switch with an actuation mechanism that is efficient, reliable, and which exhibits a relatively low actuation time.

Accordingly, some conventional microwave switching devices have been conceived that are non-mechanical microwave switching devices. For example, U.S. Pat. No. 2,493,706 to Washburne et al. discloses an electronic switch for electronically switching and modulating microwaves. More particularly, the conventional device includes an evacuated waveguide wherein an electron beam may be generated for reflecting at least a portion of microwave energy.

In another example, U.S. Pat. No. 3,281,719 to Goldberg discloses a microwave switching apparatus utilizing a spark gap inserted parallel to an electric field wherein a trigger pulse applied to the spark gap ionizes the gas in the vicinity of the gap and the microwave energy being propagated through the waveguide system causes breakdown to occur between the electrodes of the spark gap, thus creating a microwave arc.

In yet a further example, U.S. Pat. No. 4,255,731 to Birx discloses a microwave switching apparatus for producing a beam of electrons, which traverses a central portion of the narrow dimension of a rectangular cavity in a direction parallel to the electrical field of microwave energy traveling therein. The electron beam switch is intended to be used for the purpose of suddenly releasing very large amounts of stored energy accumulated in a waveguide during its so-called "open" state.

These electronic microwave switches described above may be configured for inhibiting transmission of microwave energy or releasing stored microwave energy in a single waveguide. However, there is a need for routing microwave energy to multiple output waveguides while enabling selective transmission of the microwave energy into those output waveguides. In addition, it may be desirable to provide a microwave routing element with an electronic actuation mechanism that is efficient, reliable, and which exhibits a relatively low actuation time relative to mechanical microwave switches.

BRIEF SUMMARY OF THE INVENTION

The present invention, in a number of exemplary embodiments, relates to microwave routing elements including at least one electrode for forming at least one electrical arc to selectively control microwave energy passing through the microwave routing element.

An exemplary embodiment of the present invention includes a microwave routing element comprising at least one inlet region, a plurality of outlet regions operably coupled to the at least one inlet region, and a plurality of junctures, wherein each juncture is positioned substantially between an associated outlet region and the at least one inlet region. The at least one inlet region is configured for receiving and communicating a microwave energy and the plurality of outlet regions are configured for communicating a transmitted portion of the microwave energy. Each juncture includes at least one electrode configured for generating an electrical arc across the juncture to inhibit transmission of the microwave energy through the juncture when the electrical arc is present and permit passage of the transmitted portion through the juncture when the electrical arc is absent.

Another exemplary embodiment includes a microwave routing element comprising at least one inlet region, a plurality of outlet regions operably coupled to the at least one inlet region, and a plurality of partitions, wherein each partition is positioned substantially between an associated outlet region and the at least one inlet region. The at least one inlet region is configured for receiving and communicating a microwave energy and the plurality of outlet regions are configured for communicating a transmitted portion of the microwave energy: Each partition includes a plurality of apertures formed therethrough. Each aperture is configured to allow transmission of the transmitted portion therethrough and each aperture may include at least one electrode configured for generating an electrical arc across the aperture to inhibit transmission of the microwave energy through the aperture when the electrical arc is present and permit passage of the transmitted portion through the aperture when the electrical arc is absent.

Another exemplary embodiment includes a method of directing microwave energy, the method comprising communicating a microwave energy into at least one inlet region of a microwave routing element and toward a plurality of junctures, wherein each juncture is positioned between the at least one inlet region and one of a plurality of outlet regions of the microwave routing element. The method further includes inhibiting transmission of at least a portion of the microwave energy through at least one of the plurality of junctures and into at least one of the plurality of outlet regions by selectively causing an electrical arc across the at least one of the plurality of junctures. In addition, the method includes permitting transmission of the microwave energy through the at least one of the plurality of junctures and into at least one of the plurality of outlet regions in the absence of the electrical arc.

Another exemplary embodiment includes another method of directing microwave energy, the method comprising communicating a microwave energy into at least one inlet region of a microwave routing element and toward a plurality of partitions, each partition positioned between the at least one inlet region and one of a plurality of outlet regions of the microwave routing element, and each partition including a plurality of apertures formed therethrough. The method further includes inhibiting transmission of at least a portion of the microwave energy through at least one of the plurality of apertures and into at least one of the plurality of outlet regions associated therewith by selectively causing an electrical arc across the at least one of the plurality of apertures. In addition, the method includes permitting transmission of the microwave energy through the at least one of the plurality of apertures and into at least one of the plurality of outlet regions associated therewith in the absence of the electrical arc.

Other exemplary embodiments include microwave routing systems comprising at least one microwave source configured for generating a microwave energy, a microwave routing element configured for routing the microwave energy as described in the exemplary embodiments above, and a plurality of microwave processing chambers. Each microwave processing chamber is operably coupled to at least one of a plurality of outlet regions from the microwave routing element and is configured for receiving a transmitted portion of the microwave energy communicated by the outlet region associated with that microwave processing chamber.

Other features and advantages of the present invention will become apparent to those of skill in the art through consideration of the ensuing description, the accompanying drawings, and the appended claims.

DETAILED DESCRIPTION OF THE INVENTION

Generally, the present invention relates to microwave apparatuses and methods. In the following detailed description, reference is made to the accompanying drawings hereof, which illustrate specific embodiments in accordance with the present invention. It should be understood that other embodiments may be utilized, and that various structural, process, or structural and process changes may be made to the described embodiments of the present invention without departing from the spirit and scope thereof. In addition, for clarity, like numerals may refer to like elements and functions in the various figures of the drawings and illustrating the different embodiments of the present invention.

Figure 1:
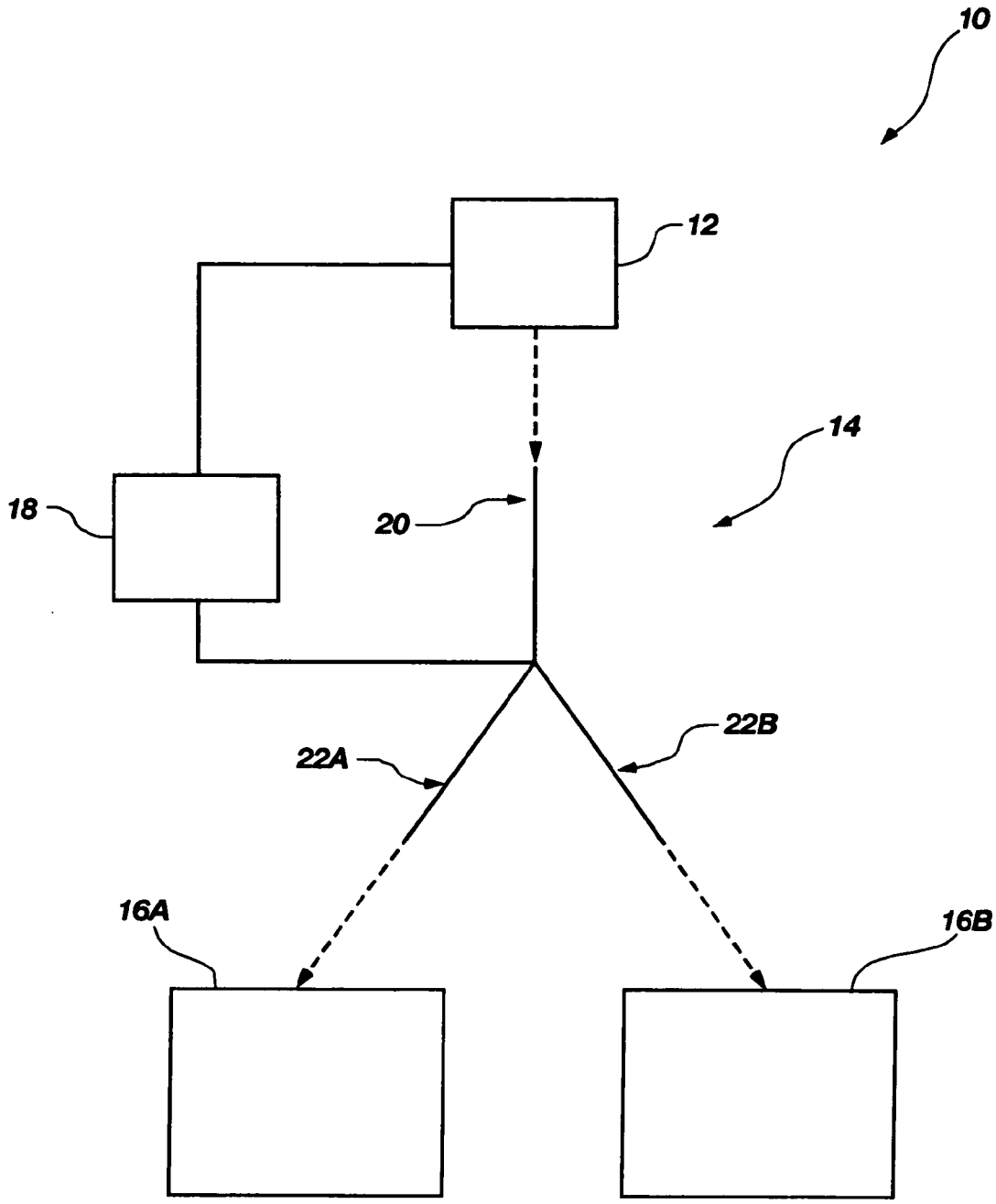
FIG. 1 shows a schematic diagram of a microwave routing system according to the present invention.

Referring to FIG. 1, a microwave routing system 10 of the present invention is illustrated schematically. The microwave routing system 10 includes a microwave source 12, a microwave routing element 14, microwave processing chambers 16A and 16B, and may optionally include a computer 18. The microwave source 12 is configured for communicating microwave energy to the microwave routing element 14. The microwave routing element 14 may be configured for accepting microwave energy into inlet region 20 and selectively conducting microwave energy through at least one of a plurality of outlet regions (shown as two outlet regions 22A and 22B), which may be configured for conducting microwave energy therethrough. In addition, the outlet regions 22A and 22B of microwave routing element 14 may be respectively coupled to microwave processing chambers 16A and 16B.

The microwave source 12, by way of example and not limitation, may comprise a microwave signal generator or microwave voltage-controlled oscillator for generating a microwave signal. Further, a high-power broadband amplifier may be employed for amplifying the microwave signal, such as, but not limited to, a traveling wave tube (TWT), tunable magnetron, tunable klystron, tunable twystron, and a tunable gyrotron, may be used to sweep a range of microwave frequencies of up to an octave in bandwidth and spanning a spectrum of from about 10 MHz to about 300 GHz. A range of microwave frequencies may be utilized, in accordance with embodiments of the present invention, and may include virtually any number of frequencies and amplitudes, without limitation.

In one application, use of microwave energy, according to exemplary embodiments of the present invention, can enhance the cure kinetics of an adhesive and can lead to selective heating during processing. Accordingly, in one embodiment, the microwave processing chambers 16A and 16B may comprise an exemplary microwave furnace generally as described in U.S. Pat. No. 5,321,222, to Bible et al., the disclosure of which is incorporated in its entirety by reference herein, but including at least two chambers for exposing an adhesive to microwaves. Similarly, in one embodiment, the microwave processing chambers 16A and 16B may comprise an exemplary microwave furnace generally as described in U.S. Pat. No. 6,758,609 to Fathi et al., the disclosure of which is incorporated in its entirety by reference herein, but including at least two chambers for exposing an adhesive to microwaves. Furthermore, exemplary microwave furnaces for carrying out embodiments of the present invention are the MICROCURE® 2100 furnace, the MICROCURE® 5100 furnace, the MICROCURE® 5300 furnace, and the VARIWAVE(™) 1500 tabletop furnace, all commercially available from Lambda Technologies, Morrisville, N.C. In addition, the microwave processing chambers 16A and 16B may include a positioning apparatus (not shown) configured for positioning or moving samples to be exposed to microwave energy relative to the microwave source in up to six degrees of freedom (e.g., translation and rotation along the X, Y and Z axes, respectively). An exemplary positioning apparatus that may be utilized in accordance with embodiments of the present invention are available from Adept Technology, Inc., San Jose, Calif.

Of course, the microwave routing system 10 according to embodiments of the present invention may be under control of the computer 18. For example, under computer control, the microwave source 12 may be configured for emitting a particular frequency, amplitude, and duration. More specifically, if the microwave routing system 10 includes a curing oven as a microwave processing chamber 16A and 16B, the microwave source 12 may be operated so as to emit an optimum incident frequency for curing a particular adhesive resin, and then may be programmed to sweep around (i.e., above or below) this optimum frequency. Such a configuration may provide a relatively effective curing environment for a given adhesive resin. Further, an optimum curing frequency of the microwave energy may change during the curing of adhesive resin. Accordingly, the frequency of the microwave energy emitted by the microwave source 12 may be adjustable, optionally under computer control, and may be adjusted during curing of an adhesive resin, if desired. In addition, the computer 18 may control the microwave routing element 14 to select the amount and type of microwave energy that may be transmitted to the microwave processing chambers 16A and 16B, as will become apparent from the discussion below.

Figure 2:
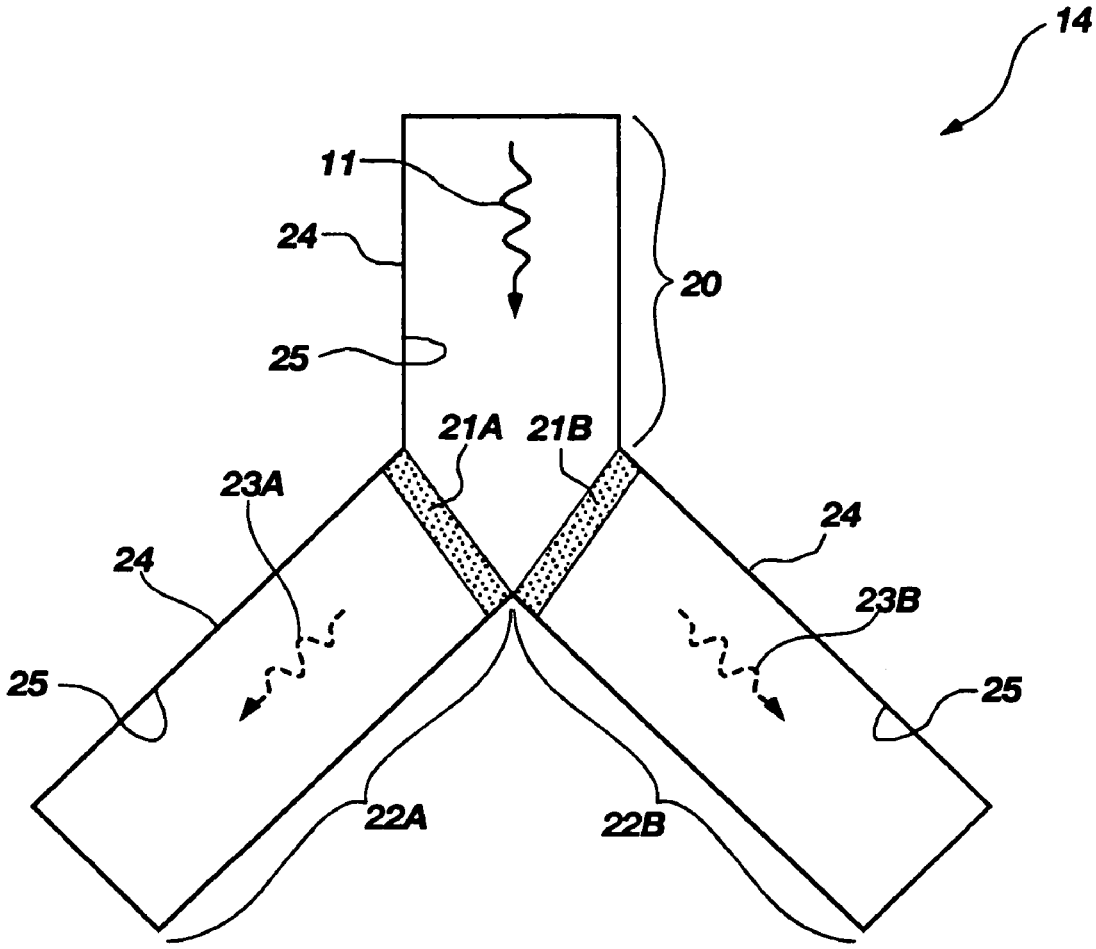
FIG. 2 shows a schematic cross-sectional view of a microwave routing element according to the present invention.

In FIG. 2, microwave routing element 14 is shown in a more detailed schematic cross-sectional view. The microwave routing element 14 includes the inlet region 20, the outlet regions 22A and 22B, and a plurality of junctures 21A and 21B (shown as shaded regions in FIG. 2). Each juncture 21A and 21B is a region substantially between a corresponding outlet region 22A and 22B and the inlet region 20. It will be readily apparent that the juncture 21A and 21B is defined for convenience of explanation to represent a physical location substantially between the inlet region 20 and an outlet region 22A and 22B, and need not represent a physical structure. The inlet region 20 and outlet regions 22A and 22B include a microwave-reflecting wall 24 for forming a microwave waveguide, as known to those of ordinary skill in the art. The microwave reflecting walls 24 may be coated with an electrically conductive coating 25, such as, for example, silver, for reducing heating due to interaction with and reflection of microwave energy.

Thus, during operation, it may be appreciated that microwave energy 11 introduced into inlet region 20 may be communicated, as a transmitted portion 23A and 23B, through one or both of outlet regions 22A and 22B, respectively. However, according to the present invention, and as illustrated in detail in FIGS. 2 and 3, at least two electrodes (generically numbered 32) may be positioned substantially near the juncture 21A and 21B of each outlet region 22A and 22B. The electrodes 32 may be configured for producing an electrical arc or beam therebetween for influencing transmission of microwave energy 11 as the transmitted portion 23A and 23B beyond the electrical arc and into one or both of the outlet regions 22A and 22B. The arc develops a small shunting impedance between the electrodes 32, which appears as a short circuit to the microwave energy 11 traveling in the inlet region 20. Thus, when present, the short circuit results in reflection of the microwave energy 11 back into the inlet region 20 rather than permitting the transmitted portion 23A and 23B to pass into the outlet region 22A and 22B as may occur when the arc is absent and the short circuit does not reflect the microwave energy 11.

Figure 3:
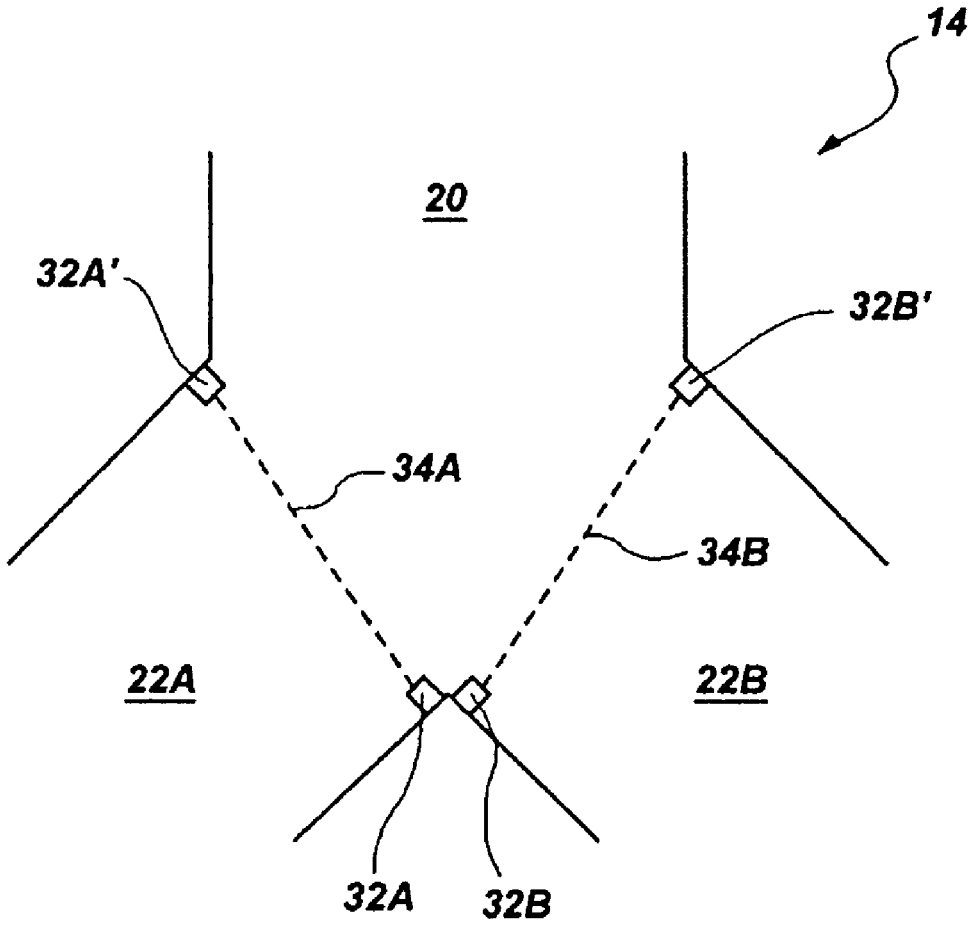
FIG. 3 shows an enlarged, partial schematic cross-sectional view of an embodiment of the microwave routing element of the present invention.

For example, as shown in FIGS. 2 and 3, which shows a partial schematic side cross-sectional view of microwave routing element 14, electrodes 32A, 32A', 32B and 32B' may be sized and positioned substantially near the junctures 21A and 21B for selectively generating an electrical arc 34A and 34B (shown as a dashed line in FIG. 3) therebetween in response to an appropriate electrical potential applied therebetween. As stated earlier, the appropriate electrical potential may be controlled by a computer 18 (FIG. 1). Thus, during operation, a sufficient electric potential may be applied between electrodes 32A and 32A' so as to cause an electrical arc 34A to form across the juncture 21A. Such an electrical arc 34A may inhibit or prevent microwave energy 11 from traveling across juncture 21A and into outlet region 22A. Similarly, a sufficient electric potential applied between electrodes 32B and 32B' may cause an electrical arc 34B to form across juncture 21 B to inhibit or prevent microwave energy 11 from traveling into outlet region 22B. Accordingly, electrodes 32A, 32A', 32B and 32B' may be employed for selectively allowing or inhibiting microwave energy 11 as transmitted portions 23A and 23B pass into and through each of outlet regions 22A and 22B, respectively. Such a configuration may be advantageous in that mechanical elements are not utilized and, therefore, the responsiveness of the microwave routing element 14 may be significantly faster, simpler to implement, and include more variable operating parameters when compared to mechanical microwave switching apparatuses. Further, characteristics of the electrical arc may be selected in relation to at least one characteristic of the microwave energy. For instance, a voltage for producing an electrical arc may be selected in relation to the frequency or amplitude of microwave energy to be inhibited (e.g., reflected) therewith. Accordingly, a suitable electrical arc intensity may be selected for reflecting microwave energy having anticipated characteristics.

More generally, the present invention contemplates that at least one electrode may be employed for selectively allowing or preventing microwave energy 11 transmission across each juncture 21A and 21B. Such a configuration may provide a mechanism for controlling an amount of the transmitted portion 23A and 23B communicated within a selected outlet region 22A and 22B. In the case of one electrode, the microwave-reflecting wall opposite the electrode 32A and 32B may act as a receiver for the electrical arc 34A and 34B, respectively.

Figure 4A:
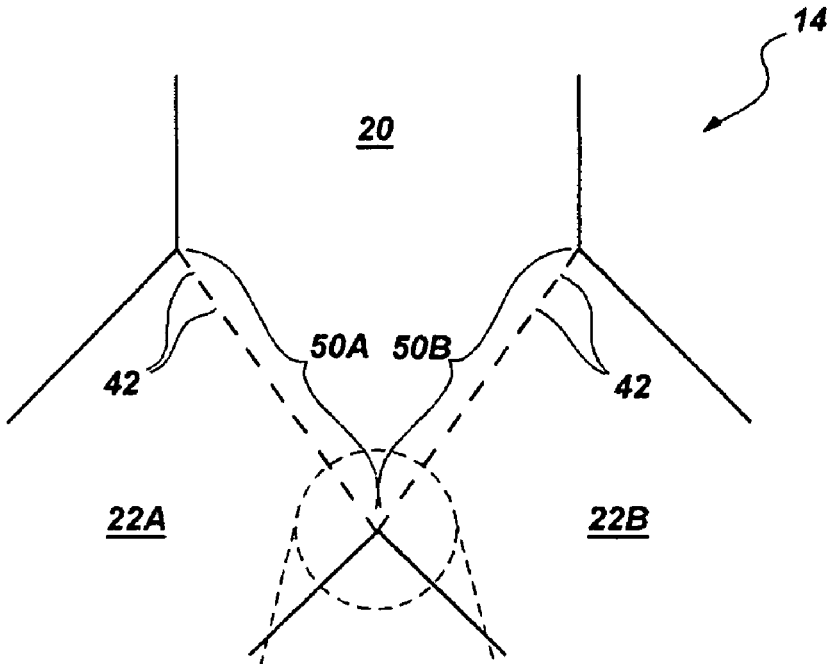
FIG. 4A shows an enlarged, partial schematic cross-sectional view of another embodiment of the microwave routing element of the present invention.

Another exemplary embodiment of the present invention is illustrated in FIGS. 2 and 4A, which shows a schematic side cross-sectional view of the microwave routing element 14. In this embodiment, partitions 50A and 50B are placed generally in the area of the junctures 21A and 21B between outlet regions 22A and 22B and the inlet region 20. Apertures 42 are formed along the partitions 50A and 50B and may be positioned generally along the partition 50A and 50B. These apertures 42 may be sized and positioned for allowing microwave energy to pass, absent other influences, therethrough under operating conditions wherein microwave energy is communicated within inlet region 20.

Figure 4B:
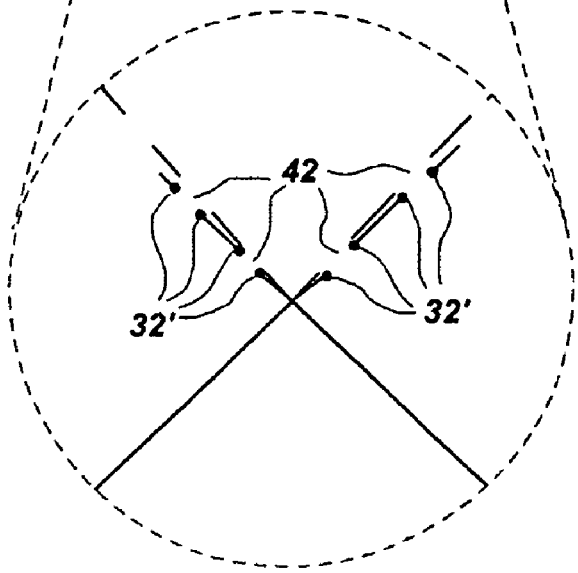
FIG. 4B shows an enlarged, partial schematic cross-sectional view illustrating electrodes across apertures in partitions in the microwave routing element shown in FIG. 4A.

In addition, as shown in FIG. 4B, which shows an enlarged partial schematic side cross-sectional view of the microwave routing element 14 shown in FIG. 4A, electrodes 32' may be placed proximate each of the apertures 42 and may be sized and configured for selectively and individually creating an electrical arc across each of the apertures 42. Put another way, each of apertures 42 may include at least two electrodes 32' configured for producing an electrical arc thereacross for inhibiting (e.g., reflecting) microwave energy from passing therethrough. Of course, each individual arc may be generated by applying a sufficient voltage between electrodes 32', respectively. As with the embodiments of FIG. 3, a voltage on the electrodes 32' of the embodiment of FIG. 4B may be selected in relation to at least one characteristic, such as, for example, amplitude and frequency of the microwave energy.

Thus, such an electrical arc (for each aperture 42) may be configured for selectively preventing microwave energy from passing through each aperture 42. Although electrodes 32' are shown as positioned toward outlet regions 22A and 22B (with respect to partitions 50A and 50B, respectively, electrodes 32' may be positioned toward inlet region 20, if so desired. However, positioning electrodes 32' away from inlet region 20 (with respect to partitions 50A and 50B) may reduce undesirable interaction with microwave energy.

It may be further appreciated that, as known in the art, microwave energy that is reflected within microwave routing element 14 may generate electrical potentials between adjacent electrodes 32 due to the interaction of the electromagnetic waves therewith. Thus, electrodes 32 may be structured, sized, and spaced from one another so that a maximum electric potential generated by interaction with microwave energy does not cause an electrical arc to form between proximate electrodes 32. Put another way, electrodes 32 may be sized and configured for preventing or at least inhibiting spontaneous electrical discharge due to interaction with microwave energy (within microwave routing element 14) alone. Such a configuration may simply allow microwave energy to be transmitted or conducted through the apertures 42 and within microwave routing element 14.

In another aspect of the present invention, it may be appreciated that microwave energy introduced within microwave routing element 14 may be shared or apportioned between a plurality of outlet regions 22A and 22B. For instance, as shown in FIG. 4A, a first plurality of apertures 42 in partition 50A may be selected for allowing microwave energy to pass therethrough, while a second plurality of apertures 42 in partition 50B may be selected for preventing (or at least inhibiting) microwave energy passing therethrough. Accordingly, the amount of microwave energy introduced within inlet region 20 may be transferred proportionally to each of outlet regions 22A and 22B generally according to the relative number, respectively, of apertures 42 of each of partitions 50A and 50B selectively allowing transmission of microwave energy therethrough (i.e., "open" apertures 42).

Such a configuration may allow for microwave processing to be accomplished in an efficient manner. For instance, assuming that a plurality of outlet regions 22A and 22B are operably connected to a respective plurality of microwave processing chambers 16A and 16B, microwave energy may be supplied to at least some of the plurality of microwave processing chambers 16A and 16B, while microwave energy may be prevented from communication with others of the plurality of microwave processing chambers 16A and 16B. Such a configuration may allow for staging and preparation in some of the plurality of microwave processing chambers 16A and 16B while other microwave processing chambers 16A and 16B experience microwave energy. Such a configuration may reduce the amount of time that the microwave source 12 is unused, resulting in greater utilization thereof.

Alternatively or additionally, the electrodes 32 may be employed for implementing a time on, time off control approach (i.e., pulse width modulation) for allowing or preventing transmission of microwave energy through the microwave routing element 14. In such an approach, microwave energy may be introduced into the microwave routing element 14 and the electrodes 32 may be energized for a selected amount of time and the electrodes 32 may be de-energized for another selected amount of time. By adjusting the ratio of the on time and the off time, relatively refined control of the microwave energy (e.g., average power) transmitted through the microwave routing element 14 may be controlled.

In another aspect of the present invention, at least one aperture may be structured for allowing a particular range of frequencies therethrough when an arc is not generated thereacross. Explaining further, by virtue of the size of an aperture, a minimum frequency (i.e., a maximum wavelength) may be passed therethrough. Expanding further, a plurality of apertures 42 may exhibit sizes for passing selected ranges of frequencies therethrough. Such a configuration may allow for selectively energizing electrodes 32' associated with those apertures 42 exhibiting the capability for allowing a particular frequency or particular frequencies of microwave energy therethrough. Such a configuration may simplify control of microwave energy through apertures 42 in a microwave routing element 14 of the present invention.

Figure 4C:
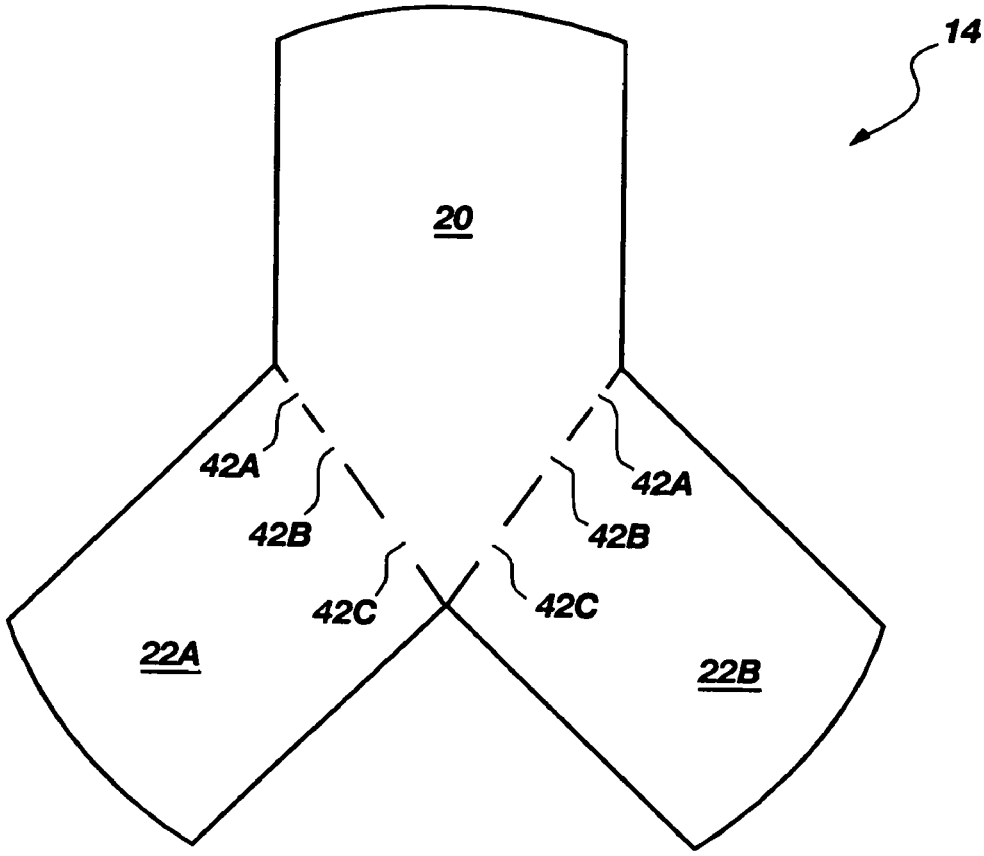
FIG. 4C shows an enlarged, partial schematic cross-sectional view illustrating different sized apertures in partitions in the microwave routing element of the present invention.

In one example, as shown in FIG. 4C, which shows a partial side cross-sectional view of a microwave routing element 14, wherein a size of each of apertures 42A, 42B, and 42C is different. Thus, each of apertures 42A, 42B, and 42C is configured for allowing a selected range of microwave frequency therethrough, and, of course, apertures 42B may pass microwave frequencies that apertures 42A are capable of passing, while apertures 42C may pass the microwave frequencies that apertures 42A and 42B are capable of passing. Electrodes 32 (not shown) may be positioned for generating an electrical arc across each of apertures 42A, 42B, and 42C, according to the present invention.

In a further aspect of the present invention, it may be further understood that more than one microwave source 12 may be utilized, if desirable. For example, the microwave source 12 illustrated in FIG. 1 may include multiple microwave sources 12 directed at the inlet region 20 of the microwave routing element 14. Such a configuration may allow for the different microwave sources 12 to be operated with various parameters, such as, for example, different frequencies, amplitudes, and powers. This configuration may also allow switching between the various sources so that the sources may be multiplexed onto the inlet region 20 or one source may be removed for service, upgrade, or the like.

While the present invention has been disclosed in terms of certain preferred embodiments, those of ordinary skill in the art will recognize and appreciate that the invention is not so limited. Additions, deletions, and modifications to the disclosed embodiments may be effected without departing from the scope of the invention as claimed herein. Similarly, features from one embodiment may be combined with those of another while remaining within the scope of the invention.

What is claimed is:

1. A microwave routing element, comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of junctures, each juncture of the plurality positioned substantially between the at least one inlet region and an outlet region of the plurality of outlet regions and comprising at least one electrode associated with the juncture and configured for generating an electrical arc across the juncture to inhibit transmission of the microwave energy through the juncture when the electrical arc is present and permit passage of the transmitted portion through the juncture when the electrical arc is absent;

wherein the at least one electrode is further configured to generate the electrical arc with a voltage suitable for inhibiting at least a portion of the microwave energy comprising an amplitude of the microwave energy and a wavelength of the microwave energy correlated to the voltage.

2. The microwave routing element of claim 1 wherein an electrode set, comprising the at least one electrode associated with each juncture of the plurality of junctures, is configured for selectively generating the electrical arc for each electrode of the electrode set to selectively apportion the microwave energy between the plurality of outlet regions.

3. A microwave routing element, comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of partitions, each partition of the plurality positioned substantially across a juncture between the at least one inlet region and an outlet region of the plurality of outlet regions, each partition of the plurality comprising:

a plurality of apertures formed through the partition, each aperture of the plurality configured to allow transmission of the transmitted portion therethrough and each aperture comprising at least one electrode configured for generating an electrical arc across the aperture to inhibit transmission of the microwave energy through the aperture when the electrical arc is present and permit passage of the transmitted portion through the aperture when the electrical arc is absent.

4. The microwave routing element of claim 3, wherein the at least one electrode is further configured to generate the electrical arc with a voltage suitable for inhibiting at least a portion of the microwave energy comprising an amplitude of the microwave energy and a wavelength of the microwave energy correlated to the voltage.

5. The microwave routing element of claim 3, wherein an electrode set, comprising the at least one electrode associated with each aperture of the plurality of apertures of each partition of the plurality of partitions, is configured for selectively generating the electrical arc for each electrode of the electrode set to selectively apportion the microwave energy between the plurality of outlet regions.

6. The microwave routing element of claim 3, wherein each partition of the plurality of partitions includes at least two apertures of the plurality of apertures with different aperture sizes configured for enabling transmission of at least two different predetermined wavelengths of the microwave energy.

7. The microwave routing element of claim 6, wherein an electrode set, comprising the at least one electrode associated with each aperture of the plurality of apertures of each partition of the plurality of partitions, is configured for selectively generating the electrical arc for each electrode of the electrode set to selectively inhibit the predetermined wavelength in at least one of the plurality of outlet regions.

8. A method of directing microwave energy, comprising:

communicating a microwave energy into at least one inlet region of a microwave routing element and toward a plurality of junctures, each juncture positioned between the at least one inlet region and one of a plurality of outlet regions of the microwave routing element;

inhibiting transmission of at least a portion of the microwave energy through at least one of the plurality of junctures and into at least one of the plurality of outlet regions by selectively causing an electrical arc across the at least one of the plurality of junctures;

permitting transmission of the microwave energy through the at least one of the plurality of junctures and into at least one of the plurality of outlet regions in the absence of the electrical arc; and generating the electrical arc with a voltage suitable for inhibiting at least a portion of the microwave energy comprising an amplitude of the microwave energy and a wavelength of the microwave energy correlated to the voltage.

9. The method of claim 8 further comprising apportioning the microwave energy between the plurality of outlet regions by selectively generating the electrical arc associated with each juncture of the plurality of junctures.

10. A method of directing microwave energy, comprising:

communicating a microwave energy into at least one inlet region of a microwave routing element and toward a plurality of partitions, each partition positioned between the at least one inlet region and one of a plurality of outlet regions of the microwave routing element, and each partition including a plurality of apertures formed therethrough; and inhibiting transmission of at least a portion of the microwave energy through at least one of the plurality of apertures and into at least one of the plurality of outlet regions associated therewith by selectively causing an electrical arc across the at least one of the plurality of apertures; and permitting transmission of the microwave energy through the at least one of the plurality of apertures and into at least one of the plurality of outlet regions associated therewith in the absence of the electrical arc.

11. The method of claim 10, further comprising generating the electrical arc with a voltage suitable for inhibiting at least a portion of the microwave energy comprising an amplitude of the microwave energy and a wavelength of the microwave energy correlated to the voltage.

12. The method of claim 10, further comprising apportioning the microwave energy between the plurality of outlet regions by selectively generating the electrical arc associated with each aperture of the plurality of apertures.

13. The method of claim 10 further comprising forming at least two different aperture sizes for each aperture of the plurality of apertures for each partition of the plurality of partitions, wherein each aperture size is configured to enable transmission of a predetermined wavelength of the microwave energy.

14. The method of claim 13, further comprising apportioning the microwave energy between the plurality of outlet regions by selectively generating the electrical arc associated with each aperture of the plurality of apertures.

15. A microwave routing system, comprising:

at least one microwave source configured for generating a microwave energy;

a microwave routing element comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of junctures, each juncture of the plurality positioned substantially between the at least one inlet region and an outlet region of the plurality of outlet regions and comprising at least one electrode associated with the juncture and configured for generating an electrical arc across the juncture to inhibit transmission of the microwave energy through the juncture when the electrical arc is present and permit passage of the transmitted portion through the juncture when the electrical arc is absent; and a plurality of microwave processing chambers, each microwave processing chamber of the plurality of operably coupled to at least one of the plurality of outlet regions and configured for receiving the transmitted portion of the microwave energy communicated by the at least one of the plurality of outlet regions;

wherein the plurality of microwave processing chambers is further configured as a microwave furnace.

16. The microwave routing system of claim 15, wherein the microwave furnace further comprises a positioning apparatus configured for accepting samples to be exposed to the transmitted portion of the microwave energy, the positioning apparatus further configured for positioning, moving, or positioning and moving the samples.

17. A microwave routing system, comprising:

at least one microwave source configured for generating a microwave energy;

a microwave routing element comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of junctures, each juncture of the plurality positioned substantially between the at least one inlet region and an outlet region of the plurality of outlet regions and comprising at least one electrode associated with the juncture and configured for generating an electrical arc across the juncture to inhibit transmission of the microwave energy through the juncture when the electrical arc is present and permit passage of the transmitted portion through the juncture when the electrical arc is absent;

a plurality of microwave processing chambers, each microwave processing chamber of the plurality operably coupled to at least one of the plurality of outlet regions and configured for receiving the transmitted portion of the microwave energy communicated by the at least one of the plurality of outlet regions; and a computer configured for controlling the at least one microwave source and the at least one electrode associated with each juncture of the plurality of junctures.

18. The microwave routing element of claim 17, wherein an electrode set comprising the at least one electrode associated with each juncture of the plurality of junctures, is configured for selectively generating the electrical arc for each electrode of the electrode set to selectively apportion the microwave energy between the plurality of outlet regions.

19. A microwave routing system, comprising:

at least one microwave source configured for generating a microwave energy;

a microwave routing element, comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of junctures, each juncture of the plurality positioned substantially between the at least one inlet region and an outlet region of the plurality of outlet regions and comprising at least one electrode associated with the juncture and configured for generating an electrical arc across the juncture to inhibit transmission of the microwave energy through the juncture when the electrical arc is present and permit passage of the transmitted portion through the juncture when the electrical arc is absent; and a plurality of microwave processing chambers, each microwave processing chamber of the plurality operably coupled to at least one of the plurality of outlet regions and configured for receiving the transmitted portion of the microwave energy communicated by the at least one of the plurality of outlet regions;

wherein the at least one electrode is further configured to generate the electrical arc with a voltage suitable for inhibiting at least a portion of the microwave energy comprising an amplitude of the microwave energy and a wavelength of the microwave energy correlated to the voltage.

20. A microwave routing system, comprising:

at least one microwave source configured for generating a microwave energy;

a microwave routing element, comprising:

at least one inlet region configured for receiving and communicating a microwave energy;

a plurality of outlet regions operably coupled to the at least one inlet region, each outlet region of the plurality configured for communicating a transmitted portion of the microwave energy from the at least one inlet region; and a plurality of partitions, each partition of the plurality positioned substantially across a juncture between the at least one inlet region and an outlet region of the plurality of outlet regions, each partition of the plurality comprising:

a plurality of apertures formed through the partition, each aperture of the plurality configured to allow transmission of the transmitted portion therethrough and each aperture comprising at least one electrode configured for generating an electrical arc across the aperture to inhibit transmission of the microwave energy through the aperture when the electrical arc is present and permit passage of the transmitted portion through the aperture when the electrical arc is absent; and a plurality of microwave processing chambers, each microwave processing chamber of the plurality operably coupled to at least one of the plurality of outlet regions and configured for receiving the transmitted portion of the microwave energy communicated by the at least one of the plurality of outlet regions.

21. The microwave routing system of claim 20, wherein the plurality of microwave processing chambers is further configured as a microwave furnace.

22. The microwave routing system of claim 21, wherein the microwave furnace further comprises a positioning apparatus configured for accepting samples to be exposed to the transmitted portion of the microwave energy, the positioning apparatus further configured for positioning, moving, or positioning and moving the samples.

23. The microwave routing system of claim 20, wherein each aperture of the plurality of apertures for each partition of the plurality of partitions includes an aperture size configured for enabling transmission of a predetermined wavelength of the microwave energy.

24. The microwave routing system of claim 20, further comprising a computer configured for controlling the at least one microwave source and the at least one electrode associated with each aperture of the plurality of apertures.

25. The microwave routing element of claim 20, wherein the at least one electrode is further configured to generate the electrical arc with a voltage suitable for inhibiting at least a portion of the microwave energy comprising an amplitude of the microwave energy and a wavelength of the microwave energy correlated to the voltage.

26. The microwave routing element of claim 20, wherein an electrode set, comprising the at least one electrode associated with each aperture of the plurality of apertures of each partition of the plurality of partitions, is configured for selectively generating the electrical arc for each electrode of the electrode set to selectively apportion the microwave energy between the plurality of outlet regions.

27. The microwave routing element of claim 20, wherein each partition of the plurality of partitions includes at least two apertures of the plurality of apertures with different aperture sizes configured for enabling transmission of at least two different predetermined wavelengths of the microwave energy.

28. The microwave routing element of claim 27, wherein an electrode set, comprising the at least one electrode associated with each aperture of the plurality of apertures of each partition of the plurality of partitions, is configured for selectively generating the electrical arc for each electrode of the electrode set to selectively inhibit the predetermined wavelength in at least one of the plurality of outlet regions.

* * * * *